US010310447B2

(12) United States Patent
Morishita et al.

(10) Patent No.: US 10,310,447 B2
(45) Date of Patent: Jun. 4, 2019

(54) ELECTROPHOTOGRAPHIC MEMBER, PROCESS CARTRIDGE, AND ELECTROPHOTOGRAPHIC IMAGE FORMING APPARATUS

(71) Applicant: CANON KABUSHIKI KAISHA, Tokyo (JP)

(72) Inventors: Hiroshi Morishita, Tsukuba (JP); Yuji Sakurai, Susono (JP); Kazutoshi Ishida, Mishima (JP); Minoru Nakamura, Mishima (JP); Toru Ishii, Mishima (JP); Ryo Sugiyama, Mishima (JP); Kenta Matsunaga, Susono (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/029,778

(22) Filed: Jul. 9, 2018

(65) Prior Publication Data

US 2019/0018362 A1 Jan. 17, 2019

(30) Foreign Application Priority Data

Jul. 12, 2017 (JP) ..... 2017-136341

(51) Int. Cl.

*G03G 15/08* (2006.01)
*G03G 21/18* (2006.01)
*G03G 5/04* (2006.01)

(52) U.S. Cl.

CPC ..... *G03G 21/1814* (2013.01); *G03G 15/0808* (2013.01); *G03G 15/0818* (2013.01); *G03G 5/04* (2013.01)

(58) Field of Classification Search

CPC .. G03G 5/04; G03G 15/0808; G03G 15/0818; G03G 15/75

See application file for complete search history.

(56) References Cited

U.S. PATENT DOCUMENTS 5,339,141 A * 8/1994 Suzuki ..... G03G 15/0818 399/285
5,502,552 A * 3/1996 Iwata ..... G03G 15/0818 399/222
6,725,002 B2 4/2004 Sakurai et al.
7,127,200 B2 * 10/2006 Nakamura ..... G03G 15/0818 399/286

(Continued)

FOREIGN PATENT DOCUMENTS

JP 2006-334934 A 12/2006
JP 2007-86498 A 4/2007

(Continued)

*Primary Examiner* — Walter L Lindsay, Jr.
*Assistant Examiner* — Arlene Heredia
(74) *Attorney, Agent, or Firm* — Venable LLP

(57) ABSTRACT

Provided is an electrophotographic member which can suppress adhesion of the toner component and fogging even in the case of printing a large number of sheets. The electrophotographic member includes an electroconductive support and an elastic layer and has convex portions composed of the elastic layer on a surface of the electrophotographic member and a filled portion containing a resin at a valley portion between the convex portions, the filled portion has a height lower than heights of the convex portions, and the surface of the electrophotographic member has a specific Martens hardness.

10 Claims, 8 Drawing Sheets

(56) References Cited

U.S. PATENT DOCUMENTS 7,201,967 B2 4/2007 Sakurai et al.
7,727,134 B2 6/2010 Nakamura et al.
7,747,204 B2 * 6/2010 Satoh ..... G03G 15/0818 399/286
7,797,833 B2 9/2010 Nakamura et al.
7,798,948 B2 9/2010 Kawamura et al.
7,799,398 B2 9/2010 Nakamura et al.
7,979,004 B2 7/2011 Tanaka et al.
8,081,911 B2 * 12/2011 Yamada ..... G03G 15/0818 399/286
8,600,273 B2 12/2013 Yamada et al.
8,655,222 B2 2/2014 Nakamura et al.
8,655,238 B2 2/2014 Uno et al.
8,660,472 B2 2/2014 Kurachi et al.
8,706,011 B2 4/2014 Anan et al.
8,768,226 B2 7/2014 Koyanagi et al.
8,768,227 B2 7/2014 Urushihara et al.
8,774,677 B2 7/2014 Sakurai et al.
8,798,508 B2 8/2014 Yamada et al.
8,837,985 B2 9/2014 Ishida et al.
8,846,287 B2 9/2014 Yamada et al.
8,874,007 B2 10/2014 Kawamura et al.
8,892,012 B2 * 11/2014 Matsunaga ..... G03G 15/08 399/286
8,913,930 B2 12/2014 Ishii et al.
9,017,239 B2 4/2015 Ishida et al.
9,482,986 B2 * 11/2016 Sakurai ..... G03G 15/0808
9,625,854 B2 4/2017 Koyanagi et al.
9,846,407 B2 12/2017 Nakamura et al.
9,921,518 B2 3/2018 Sakurai et al.
9,952,531 B2 4/2018 Ishii et al.
9,952,532 B2 4/2018 Sugiyama et al.
2006/0067747 A1 3/2006 Matsuda et al.
2006/0226572 A1 10/2006 Tanaka et al.
2013/0130022 A1 5/2013 Uesugi et al.
2013/0164038 A1 6/2013 Kusaba et al.
2013/0266339 A1 10/2013 Sugiyama et al.
2017/0097580 A1 4/2017 Ishida et al.
2017/0139336 A1 5/2017 Nagaoka et al.

FOREIGN PATENT DOCUMENTS

JP 2008-309971 A 12/2008
JP 2015-68938 A 4/2015

* cited by examiner

ELECTROPHOTOGRAPHIC MEMBER, PROCESS CARTRIDGE, AND ELECTROPHOTOGRAPHIC IMAGE FORMING APPARATUS

BACKGROUND OF THE INVENTION

Field of the Invention

The present disclosure relates to an electrophotographic member which can be used as a developing member or a charging member in an electrophotographic image forming apparatus. The present disclosure also relates to a process cartridge and an electrophotographic image forming apparatus.

Description of the Related Art

In recent years, electrophotographic image forming apparatuses such as copying machines, facsimile machines, and printers are required to exhibit higher durability than ever before.

In the process of forming an image in the electrophotographic image forming apparatus, the developing member plays a role of transporting the toner and imparting a charge to the toner. The charging of toner greatly affects the image quality, and an insufficient triboelectric charging quantity of toner also causes fogging. Hence, the developing member is required to exhibit improved toner contamination resistance than ever before in order to maintain the image quality in durability improvement. In addition, the charging member for charging the image carrier is also required to exhibit the same property.

Under these circumstances, Japanese Patent Application Laid-Open No. 2015-68938 discloses that toner releasing property is imparted by dotting the second phase rich in F element in the first phase composed of a matrix polymer in a polymer layer forming the surface of an electrophotographic member.

The inventors have examined the developing member according to the disclosure described in Japanese Patent Application Laid-Open No. 2015-68938, and as a result, the toner component hardly adheres to the surface of the developing member by the effect of the second phase rich in F element thereon. However, it is impossible to remove the toner component once adhered when a large number of sheets are printed, and as a result, the charging imparting property is likely to deteriorate and fogging occurs in some cases. In particular, this phenomenon is remarkable in a case in which the frequency of rubbing between the developing member and the toner feed roller or the toner regulating member is high, namely, in an electrophotographic image forming apparatus of a high durability machine.

SUMMARY OF THE INVENTION

One aspect of the present disclosure is directed to providing an electrophotographic member which can suppress adhesion of the toner component to the surface even in the case of printing a large number of sheets. Another aspect of the present disclosure is directed to providing an electrophotographic process cartridge which contributes to the stable formation of a high-quality electrophotographic image. Still another aspect of the present disclosure is directed to providing an electrophotographic image forming apparatus which can stably form a high-quality electrophotographic image.

According to an aspect of the present disclosure, there is provided an electrophotographic member including an electroconductive support and an elastic layer on the support, wherein the electrophotographic member has convex portions composed of the elastic layer on a surface of the electrophotographic member, the electrophotographic member has a filled portion containing a resin at a valley portion between the convex portions, the filled portion has a height lower than heights of the convex portions, the surface of the electrophotographic member include a first region which is a surface of the elastic layer uncovered with the filled portion and a second region which is a surface of the filled portion, and wherein when a Martens hardness measured at a surface of the first region is defined as H1, and a Martens hardness measured at a surface of the second region is defined as H2, H1 and H2 satisfy a following relationship: $H2>H1$.

According to another aspect of the present disclosure, there is provided an electrophotographic process cartridge which is configured to be detachably attachable to a main body of an electrophotographic image forming apparatus and equipped with a developing apparatus including the electrophotographic member described above.

According to still another aspect of the present disclosure, there is provided an electrophotographic image forming apparatus which includes an image carrier for carrying an electrostatic latent image, a charging apparatus for primarily charging the image carrier, an exposure apparatus for forming an electrostatic latent image on the image carrier primarily charged, a developing apparatus for developing the electrostatic latent image with a toner to form a toner image, and a transfer apparatus for transferring the toner image onto a transfer material and in which the developing apparatus includes the electrophotographic member described above.

Further features of the present disclosure will become apparent from the following description of exemplary embodiments with reference to the attached drawings.

DESCRIPTION OF THE EMBODIMENTS

Preferred embodiments of the present disclosure will now be described in detail in accordance with the accompanying drawings.

An electrophotographic member according to an aspect of the present disclosure includes an electroconductive support and an elastic layer on the support. The electrophotographic member has convex portions composed of the elastic layer on the outer surface thereof and a filled portion containing a resin at a valley portion between the convex portions. The filled portion has a height lower than the heights of the convex portions.

The valley portion is defined as a region between convex portions having a height lower than the height of any of the convex portions. The filled portion is defined as a part at which the valley portion is filled with a material containing a resin. The filled portion has a height lower than the heights of the convex portions.

The surface of the electrophotographic member includes a first region which is composed of an outer surface of the elastic layer uncovered with the filled portion and a second region composed of an outer surface of the filled portion. Here, the surface of the electrophotographic member refers to the outer surface of the electrophotographic member, and it is the contact surface in a case in which the electrophotographic member comes into contact with another member such as a toner feed roller, a toner regulating member, or an electrophotographic photosensitive member.

In addition, the surface of the elastic layer refers to the outer surface of the elastic layer on the side opposite to the side facing the substrate. In addition, the surface of the filled portion refers to the outer surface of the filled portion on the side opposite to the side facing the substrate.

Figure 2:
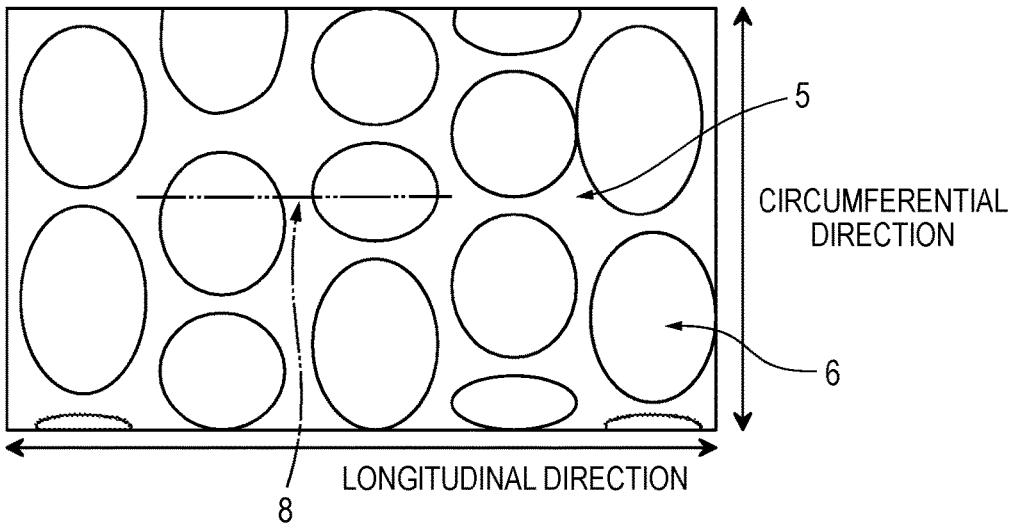
FIG. 2 is a plan view which illustrates a part of the surface of an electrophotographic member according to an aspect of the present disclosure.

FIG. 2 is a plan view which illustrates a part of the surface of an electrophotographic roller according to an aspect of the present disclosure.

As illustrated in FIG. 2, a first region 5 constitutes a continuous region (hereinafter also referred to as the "matrix") and a second region constitutes mutually independent regions (hereinafter also referred to as the "domains") 6 on the surface of the electrophotographic member.

Figure 3:
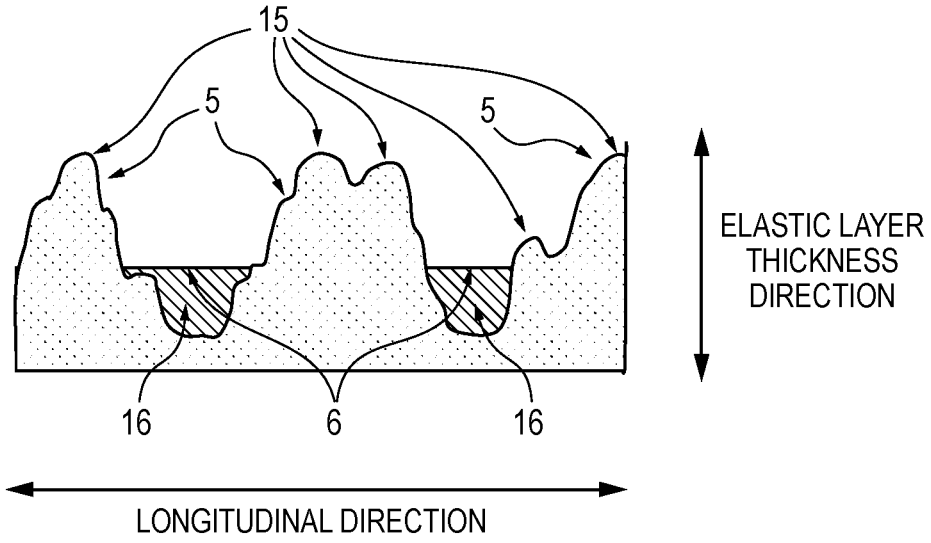
FIG. 3 is a cross-sectional view of the electrophotographic member at a line segment 8 in FIG. 2.

In addition, FIG. 3 is a cross-sectional view which illustrates a cross section when the electrophotographic member is cut on the plane including a line segment 8 in FIG. 2 and the central axis of the electrophotographic roller. As illustrated in FIG. 3, the first region 5 is a part of an elastic layer 2 and allows a convex portion 15 to be formed on the surface of the electrophotographic roller. In addition, a filled portion 16 is formed between the convex portions 15 using a material containing a resin to a height lower than the heights of these convex portions.

In addition, when the Martens hardness measured at the surface of the first region is defined as H1, and the Martens hardness measured at the surface of the second region is defined as H2, H1 and H2 satisfy a following relationship: H2>H1.

Such an electrophotographic roller can prevent adhesion of the toner component to the surface even in the case of being subjected to long-term electrophotographic image formation, for example, as a developing roller. The reason for that the electrophotographic roller exhibits such an effect is considered as follows.

Figure 6A:
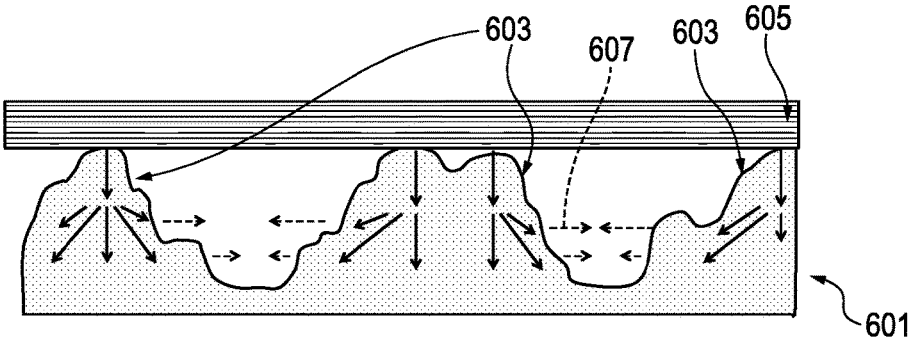
FIG. 6A is an explanatory view of the behavior of a conventional electrophotographic member when coming into contact with another member, which illustrates the state of the conventional electrophotographic member immediately after coming into contact with another member.
Figure 6B:
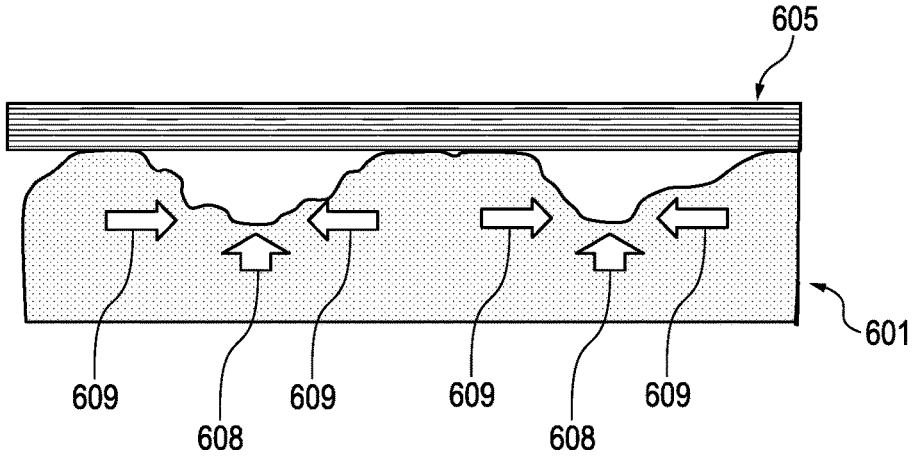
FIG. 6B is an explanatory view of the behavior of a conventional electrophotographic member when coming into contact with another member, which illustrates a state in which the elastic layer is deformed by the contact pressure with another member.

First, a case of a conventional electrophotographic member which has convex portions on the surface but does not have a filled portion between the convex portions, that is, does not have a part corresponding to the second region 6 will be described. The electrophotographic member has an elastic layer 601 constituting the entire surface and a convex portion 603 composed of the elastic layer as illustrated in FIG. 6A. The convex portion 603 corresponds to the first region in the electrophotographic member according to the present aspect but does not have a part corresponding to the second region. The convex portion 603 is crushed when such an electrophotographic member comes into contact with another member 605. Moreover, the bottom portion between the convex portions 603 is deformed so as to swell in the direction indicated by an arrow 608 in FIG. 6B by the force (see arrow 607 in FIG. 6A) trying to restore the volume of the crushed part. The deformation of the convex portion 603 in the direction indicated by an arrow 609 in FIG. 6B at this time is presumed to be small and monotonous deformation as the deformation in a minute region on the surface of the electrophotographic member. As a result, it is considered that the toner component is hardly peeled off and contamination due to the toner component accumulates even when the toner component adheres to the surface of the electrophotographic member by long-term use.

Figure 7A:
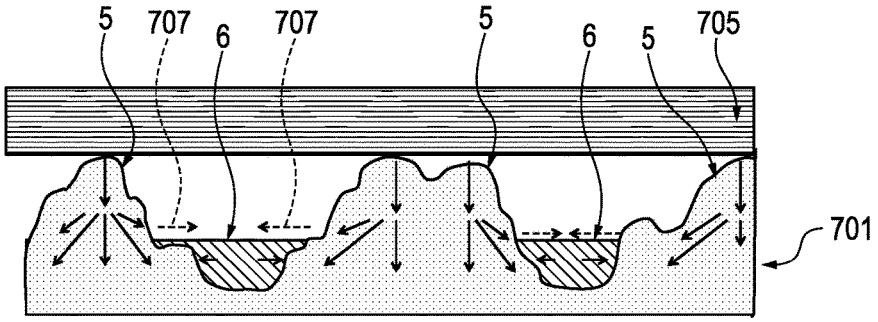
FIG. 7A is an explanatory view of the behavior of an electrophotographic member according to an aspect of the present disclosure when coming into contact with another member, which illustrates the state of the electrophotographic member immediately after coming into contact with another member.
Figure 7B:
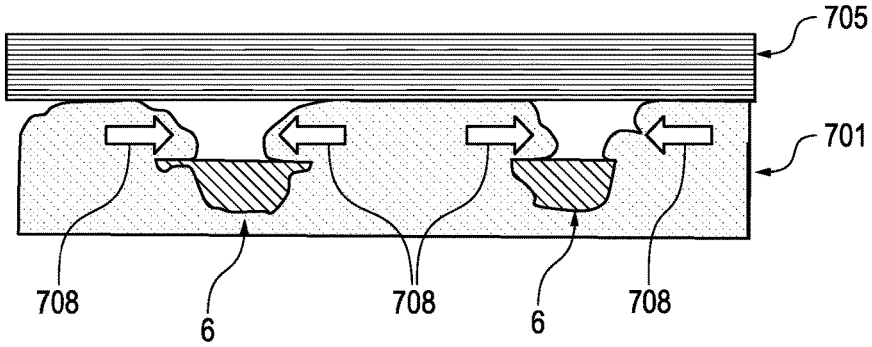
FIG. 7B is an explanatory view of the behavior of an electrophotographic member according to an aspect of the present disclosure when coming into contact with another member, which illustrates a state in which the elastic layer is deformed by the contact with another member.

On the other hand, in the electrophotographic member according to the present aspect, the outer surface is composed of the first region and the second region having mutually different Martens hardnesses as illustrated in FIG. 7A. The convex portion in the first region is crushed by the contact pressure when such an electrophotographic member comes into contact with another member 705. The force (arrow 707 in FIG. 7B) trying to restore the volume of the crushed part acts. However, swelling of the bottom portion is restricted by the second region which is present between the convex portions 15 and has a high hardness. As a result, a part of the elastic layer constituting the first region moves in the direction indicated by an arrow 708 in FIG. 7B and is deformed so as to cover a part of the surface of the second region 6. Such deformation of the convex portion 15 is presumed to be great and complicated deformation as the deformation in a minute region on the surface of the electrophotographic member.

In a case in which the toner component adheres to the surface of the electrophotographic member in a layered form, the film of the layered toner component cannot follow the deformation as the deformation of the concavoconvex shape on the surface is greater and more complicated deformation. As a result, cracking and peeling off of the layered toner is promoted. Hence, it is possible to suppress accumulation of contamination due to the toner component on the surface of the electrophotographic member.

Figure 1A:
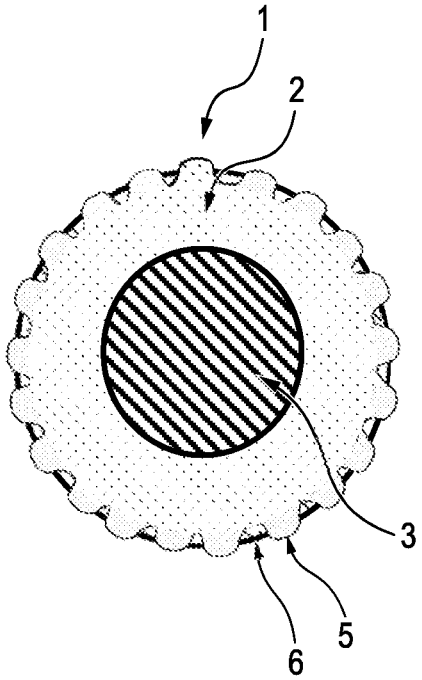
FIG. 1A is a cross-sectional view of an electrophotographic member according to an aspect of the present disclosure, in which an elastic layer is composed of one layer.
Figure 1B:
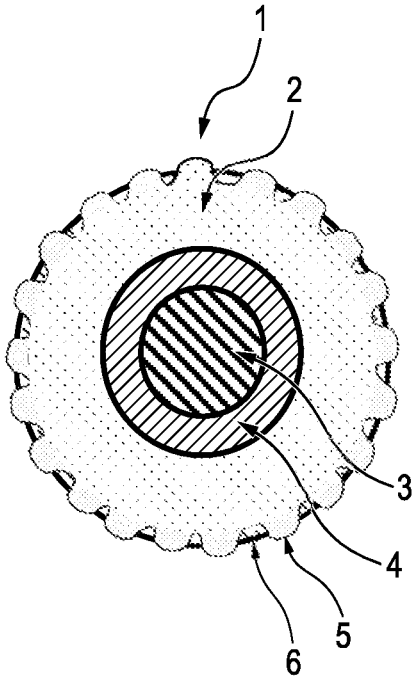
FIG. 1B is a cross-sectional view of an electrophotographic member according to an aspect of the present disclosure, in which an elastic layer is composed of two layers.

Hereinafter, the electrophotographic member according to the present disclosure will be described by taking a roller-shaped developing member as an example, but the present disclosure is not limited thereto. In the nonmagnetic one-component contact developing process, a developing roller in which a second elastic layer (lower layer) 4 is disposed between a mandrel 3 and the elastic layer 2 as the surface layer is suitably used, for example, as illustrated in FIG. 1B.

[Support]

As the support, for example, a columnar or cylindrical mandrel can be used. The support is composed of, for example, the following electroconductive materials.

Metals or alloys such as aluminum, copper alloy, and stainless steel; iron plated with chromium or nickel; and a synthetic resin exhibiting electroconductivity.

The outer surface of the support may be appropriately coated with a known adhesive for the purpose of improving the adhesive property to the elastic layer to be provided on the outer surface thereof.

[Elastic Layer]

The elastic layer contains an elastic material such as a resin or a rubber. Specific examples of the resin and the rubber may include the following. Polyamide, nylon, a polyurethane resin, a urea resin, polyimide, a melamine resin, a fluororesin, a phenol resin, an alkyd resin, polyester, polyether, an acrylic resin, and any mixture thereof. Ethylene-propylene-diene copolymer rubber (EPDM), acrylonitrile-butadiene rubber (NBR), chloroprene rubber (CR), natural rubber (NR), isoprene rubber (IR), styrene-butadiene rubber (SBR), fluororubber, silicone rubber, epichlorohydrin rubber, and hydride of NBR. Among these, a polyurethane resin is preferable since it easily obtains an opportunity for contact with the toner as it exhibits excellent triboelectric charging performance to toner and excellent flexibility and it exhibits abrasion resistance. In addition, it is preferable to use a polyurethane resin as the outermost elastic layer 2 in a case in which the elastic layer has a laminated structure of two or more layers as well. Examples of the polyurethane resin may include an ether-based polyurethane resin, an ester-based polyurethane resin, an acrylic polyurethane resin, a fluorine-based polyurethane resin, a carbonate-based polyurethane resin, and an olefin-based polyurethane resin.

The polyurethane resin can be obtained from a polyol and an isocyanate, and a chain extender can be used if necessary. Examples of the polyol to be a raw material of the polyurethane resin may include polyether polyol, polyester polyol, polycarbonate polyol, polyolefin polyol, acryl polyol, and any mixture thereof. Examples of the isocyanate to be a raw material of the polyurethane resin may include the following. Tolylene diisocyanate (TDI), diphenylmethane diisocyanate (MDI), naphthalene diisocyanate (NDI), tolidine diisocyanate (TODI), hexamethylene diisocyanate (HDI), isophorone diisocyanate (IPDI), phenylene diisocyanate (PPDI), xylylene diisocyanate (XDI), tetramethylxylylene diisocyanate (TMXDI), cyclohexane diisocyanate, and any mixture thereof. Examples of the chain extender to be the raw material of the polyurethane resin may include bifunctional low molecular weight diol such as ethylene glycol, 1,4-butanediol, and 3-methylpentanediol, trifunctional low molecular weight triols such as trimethylol propane, and any mixture thereof.

In addition, silicone rubber is preferable as a material constituting the elastic layer (lower layer) 4 on the mandrel in a case in which the elastic layer has a laminated structure of two or more layers. Examples of the silicone rubber may include polydimethylsiloxane, polymethyltrifluoropropylsiloxane, polymethylvinylsiloxane, polyphenylvinylsiloxane, and any copolymer of these siloxanes. These resins and rubbers can be used singly or in combination of two or more kinds thereof, if necessary. Incidentally, the materials of the resin and the rubber can be identified by being measuring by using a Fourier transform infrared spectrophotometer.

In addition, the elastic layer can contain various kinds of additives such as particles, a conducting agent, a plasticizer, a filler, an extending agent, a vulcanizing agent, a vulcanization aid, a crosslinking aid, a curing inhibitor, an antioxidant, an age resistor, and a processing aid if necessary. These optional components can be blended in amounts in which the function of the elastic layer is not hindered.

It is possible to form a convex portion on the surface of the electrophotographic member by containing particles in the elastic layer. With regard to the particles that can be added to the elastic layer, the volume average particle diameter thereof is preferably 1 μm or more and 30 μm or less. Incidentally, the particle diameter can be measured by observing the cross-sectional surface of particles under a scanning electron microscope (trade name: JSM-7800 FPRIME Schottky field emission type scanning electron microscope, manufactured by JEOL Ltd.).

The amount of the particles contained in the elastic layer is preferably 1 part by mass or more and 50 parts by mass with respect to 100 parts by mass of the elastic material such as a resin or a rubber. As the particles, it is possible to use fine particles composed of a resin such as a polyurethane resin, polyester, polyether, polyamide, an acrylic resin, or polycarbonate. Among these, the polyurethane resin particles are preferable since the polyurethane resin particles are flexible and thus effective to prevent toner contamination as the convex portion is greatly collapsed and is likely to be complicatedly deformed when the electrophotographic member comes into contact with another member.

The elastic layer can be formed into an electroconductive elastic layer in which an elastic material is blended with an electroconductivity imparting agent such as an electronically conductive substance or an ion conductive substance. Examples of the electronically conductive substance may include the following substances.

Electroconductive carbons, for example, carbon black such as Ketjen black EC and acetylene black; carbon for rubber such as Super Abrasion Furnace (SAF), Intermediate SAF (ISAF), High Abrasion Furnace (HAF), Fast Extruding Furnace (FEF), General Purpose Furnace (GPF), Semi-Reinforcing Furnace (SRF), Fine Thermal (FT), and Medium Thermal (MT); carbon for color (ink) subjected to an oxidation treatment; and metals such as copper, silver, and germanium and metal oxide thereof.

Among these, electroconductive carbon is preferable since it is easy to control the electroconductivity using a small amount of electroconductive carbon. Examples of the ion conductive substance may include the following substances. Inorganic ion conductive substances such as sodium perchlorate, lithium perchlorate, calcium perchlorate, and lithium chloride; and organic ion conductive substances such as modified aliphatic dimethyl ammonium ethosulfate and stearyl ammonium acetate.

Examples of the filler may include silica, quartz powder, and calcium carbonate.

Mixing of the respective materials for elastic layer can be performed by using a dynamic mixing apparatus such as a uniaxial continuous kneader, a biaxial continuous kneader, a double roll, a kneader mixer, or Trimix or a static mixing apparatus such as a static mixer.

Examples of the method of forming the elastic layer on the support may include a mold molding method, an extrusion molding method, an injection molding method, and a coating molding method. The method of forming the first region to form the convex portion will be described later. In the mold molding method, for example, a piece for holding the mandrel in the mold is first fixed to both ends of a cylindrical mold and an injection port is formed to the piece. Subsequently, the mandrel is disposed in the mold, the materials for elastic layer are injected into the mold through the injection port, then the mold is heated at a temperature at which the materials are cured and released from the mold. In the extrusion molding method, for example, the mandrel and the materials for elastic layer are extruded together by using a crosshead extruder, and the materials are cured, whereby an elastic layer can be formed around the mandrel.

In the case of forming the elastic layer to have a laminated structure of two or more layers, the surface of the elastic layer (lower layer) on the side of the mandrel may be polished in order to improve the adhesive property or the surface can also be modified by a surface modification method such as a corona treatment, a flame treatment, or an excimer treatment.

[Second Region]

It is the role of the second region to put the convex portion in the first region, which has a particularly high contact pressure with another member, in a greatly and complicatedly deformed and collapsed state. In order to achieve this, the Martens hardness H2 measured at the surface of the second region is set to be higher than the Martens hardness H1 measured at the surface of the first region. For this, the valley portion between the convex portions is filled with a material containing a resin harder than the material (material for elastic layer) constituting the first region to form a filled portion.

Examples of such a resin are mentioned below. An acrylic resin, a fluororesin, a styrene resin, a polyurethane resin, polyolefin, an epoxy resin, and polyester. Among these, an acrylic resin, a styrene resin, a fluororesin, an acrylic polyurethane resin, a fluorine-based polyurethane resin from the viewpoint of the following Martens hardness.

Specific examples of the acrylic resin may include polymers and copolymers using the following monomers as raw materials. Methyl methacrylate, 4-tert-butyl cyclohexanol acrylate, stearyl acrylate, lauryl acrylate, 2-phenoxyethyl acrylate, isodecyl acrylate, isooctyl acrylate, isobornyl acrylate, 4-ethoxylated nonylphenol acrylate, isobornyl acrylate, and ethoxylated bisphenol A diacrylate.

The styrene resin may be a homopolymer of styrene or a copolymer with an acrylic resin and the like. In addition, a copolymer with, for example, a double-bond monomer having a salicylic acid structure can also be used in order to control the charging imparting property.

Examples of the method of forming the filled portion may include a method using a jet dispenser or a method by screen printing. Alternatively, an electrophotographic member provided with a filled portion can be formed by a method in which a material for filled portion formation is applied by a roll coating, spraying, or dipping method. In this case, a material which causes cissing by the surface tension to the elastic layer and is arranged between the convex portions provided on the surface of the elastic layer to a height lower than the heights of these convex portions can be used as the material for filled portion formation. Specifically, examples of the second region forming material with respect to the elastic layer composed of an ester-based polyurethane resin or an ether-based polyurethane resin may include an acrylic resin, a fluororesin, a styrene resin, an acrylic polyurethane resin, a fluorine-based polyurethane resin, and an ester-based polyurethane resin or an ether-based polyurethane resin which is different from the elastic layer.

A conducting agent may not be blended in the filled portion, but a resin blended with a conducting agent can also be used. Incidentally, the conducting agents described in the column of "elastic layer and first region" can be used in the case of blending a conducting agent.

[Height of Convex Portion and Height of Filled Portion]

The first region, which is an exposed part of the elastic layer, allows the convex portion to be formed on the surface of the electrophotographic member. By this, a convex shape to be collapsed is favorably provided for great and complicated deformation in a minute region on the surface of the electrophotographic member at the contact portion with another member such as a toner feed roller, a toner regulating member, or an image carrier, which is effective for generating the effect of the present disclosure. Such convex portion can be formed, for example, by adding rough particles into the elastic layer or by mold transfer onto the surface of the elastic layer.

The second region is the surface of a region (namely, filled portion) in which a material containing a resin is filled in between the convex portions provided on the surface of the elastic layer by a height lower than the heights of the convex portions. By adopting such a configuration, it is possible to apply a great contact pressure with another member to the convex portion in the first region and to generate great and complicated deformation at the convex portion.

In addition, the second region is rubbed while the contact pressure with another member is applied to the second region in a case in which the height of the filled portion, which is the second region, is higher than the convex portion in the first region. As a result, peeling off is likely to occur at the interface between the elastic layer and the second region. In other words, it is possible to suppress peeling off of the second region due to rubbing with another member when the height of the filled portion, which is the second region, is lower than the heights of the convex portions in the first region.

The average value of the heights of the convex portions in the first region is denoted as L1 and the average value of the heights of the filled portions is denoted as L2. Each of these can be determined as follows.

Figure 8:
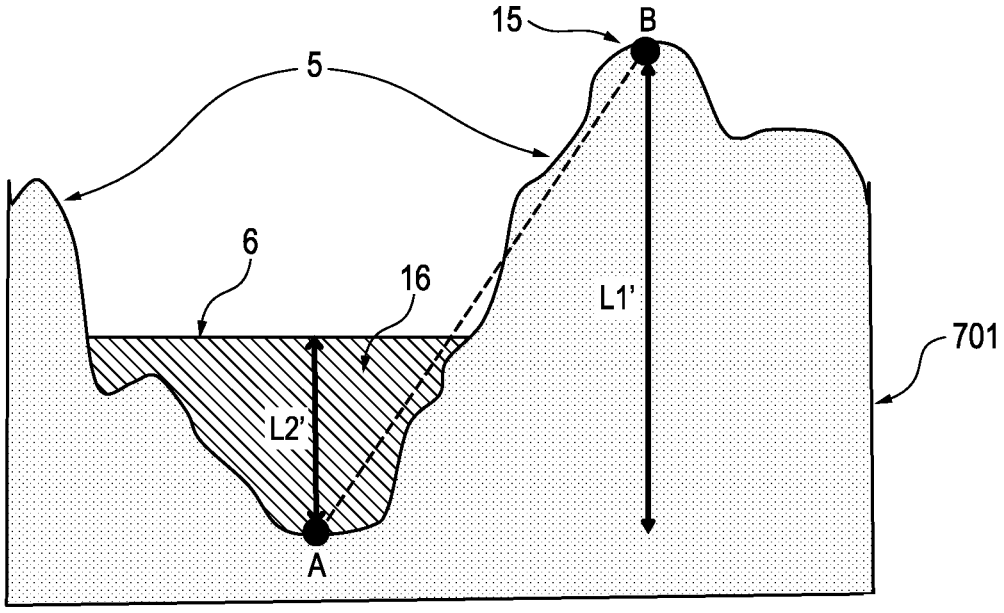
FIG. 8 is an explanatory view of a method of calculating the heights of a first region and a second region in an electrophotographic member according to an aspect of the present disclosure.

A razor blade is inserted into the surface of the electrophotographic member and the elastic layer (rubber piece) including the first region and the second region is cut out. With regard to this, the cross section (particularly, a cross section in the thickness direction of the elastic layer along the longitudinal direction) of the electrophotographic member is observed under a scanning electron microscope (trade name: JSM-7800 FPRIME Schottky field emission type scanning electron microscope, manufactured by JEOL Ltd.). In the cross section, the maximum value among the distances from the surface of the second region 6 (the surface of the filled portion 16) to the interface between the filled portion and the elastic layer in the elastic layer thickness direction (the direction toward the central axis of the mandrel) is denoted as L2' as illustrated in FIG. 8. In addition, in the cross section, a point at the interface between the filled portion and the elastic layer at this time (when giving the maximum value) is denoted as point A and the vertex of the highest convex portion in the first region adjacent to the second region at this time is denoted as point B. The length of the side located in the elastic layer thickness direction from the point B in a right triangle having the line AB as the hypotenuse is denoted as L1'. The above measurement is performed at arbitrary 20 places on the surface of the electrophotographic member and the arithmetic mean values of the heights L1' of the convex portions in the first region and the heights L2' of the filled portions thus obtained are denoted as the average value L1 of the heights of the convex portions and the average value L2 of the heights of the filled portions, respectively.

This height L1' of the convex portion can be appropriately adjusted by the volume average particle diameter of the particles and the parts of particles added when the convex portion is formed by addition of particles. In addition, the height L1' of the convex portion can be adjusted by the mold dimension when the convex portion is formed by mold transfer molding. The height L1' of the convex portion is preferably 3 μm or more and 20 μm or less.

The height L2' of the filled portion can be appropriately adjusted by the solid concentration in the coating material for second region (filled portion) and the coating method. The height L2' of the filled portion is preferably 0.8 μm or more and 16 μm or less. This is because the convex portion in the first region is a state of being more collapsed on the second region in a minute region on the surface of the electrophotographic member at the contact portion with another member and greater and more complicated deformation can be generated as the convex portion in the first region and the filled portion have proper heights.

Incidentally, the relationship between the average height L2 of the filled portions and the average height L1 of the convex portions is such that L2/L1 is preferably 0.2 or more and 0.8 or less and more preferably 0.3 or more and 0.7 or less. When the relationship is in the above range, the swelling of the bottom portion is further suppressed and a part of the convex portions in the first region is in a state of being more greatly collapsed on the second region by the presence of the second region (filled portion) when the convex portion in the first region is going to be collapsed at the contact portion with another member. As a result, it is possible to generate greater and more complicated deformation as the deformation in a minute region on the surface of the electrophotographic member. Moreover, a part of the surface does not peel off, contamination due to the toner component is suppressed, and high durability without deterioration in performance can be maintained in the durable use as well.

[Hardness Measured at Surfaces of First Region and Second Region]

In the electrophotographic member, the Martens hardness H1 measured at the first region of a region in which the elastic layer is exposed is preferably 0.2 $N/mm^2$ or more and 25.0 $N/mm^2$ or less. This is because the contact portion is more hardly scraped by the rubbing with the toner feed roller and the toner regulating member and is likely to be collapsed when the hardness is in this range.

The Martens hardness H1 can be measured by using an ultramicro hardness tester (trade name: PICOPDENTOR HM-500, manufactured by Helmut Fischer).

As the measurement place, for example, in a case in which the first region constitutes the matrix as illustrated in FIG. 2, it is possible to adopt a place at a distance from each of the second regions adjacent to the first region in the first region. In addition, in a case in which the first region constitutes a domain, it is possible to adopt a place at a distance from the second region surrounding the first region in the first region. In other words, it is possible to adopt a place as far apart as possible from the second region, for example, a surface at the center of the first region as the measurement place.

Incidentally, a square pyramid diamond is used as the measurement indenter, and conditions of an indenter penetration speed of 100 nm/sec, a maximum indentation load of 0.01 N, an indentation time of 10 seconds, and a creep time of 10 seconds can be adopted. The Martens hardness H1 ($N/mm^2$) is determined by substituting the indentation depth (mm) obtained by the measurement into the following Calculation Formula (1).

$$\text{Martens hardness} = \text{maximum indentation load}/26.43 \times (\text{indentation depth})^2 \qquad \text{Calculation Formula (1)}$$

The Martens hardness H2 is preferably 1.2 $N/mm^2$ or more and 32.0 $N/mm^2$ or less. When the hardness is in this range, the convex portion in the first region is going to be collapsed whereas the filled portion constituting the second region has a proper hardness and thus can further suppress swelling of the bottom portion at the contact portion with another member. As a result, the convex portion in the first region is in a state of being more collapsed on the second region and the effect of the present disclosure is more likely to be exerted.

As the method of measuring the Martens hardness H2, the same method as the method of measuring the Martens hardness H1 can be adopted. As the measurement place, for example, in a case in which the second region 6 constitutes the domain as illustrated in FIG. 2, it is possible to adopt a place at a distance from the first region surrounding the second region in the second region.

In addition, in a case in which the second region constitutes the matrix, it is possible to adopt a place at a distance from each of the first regions adjacent to the second region in the second region. In other words, it is possible to adopt a place as far apart as possible from the first region, for example, a surface at the center of the second region as the measurement place.

In order to confirm that H2>H1, H1 and H2 are respectively measured at arbitrary 20 places at the surface of the electrophotographic member and it is confirmed that the H2 obtained at all the 20 places are higher than the H1 obtained at all the 20 places. At this time, H2min>H1max is satisfied where the minimum value among H2 at 20 places is defined as H2min and the maximum value among H1 at 20 places is defined as H1max.

In addition, the difference (H2−H1) between H1 and H2 is preferably 0.5 $N/mm^2$ or more and 35.0 $N/mm^2$ or less and more preferably 1.0 $N/mm^2$ or more and 30.0 $N/mm^2$ or less. When the difference is in the above range, it is possible to generate greater and more complicated deformation while maintaining stronger adhesive property between the first region and the second region. As a result, a part of the surface does not peel off, contamination due to the toner component is suppressed, and high durability without deterioration in performance can be maintained in the durable use as well.

Here, it is preferable that (H2min−H1max) is in the above range in a case in which H1 and H2 are respectively measured at arbitrary 20 places of the electrophotographic member as described above.

[Coverage Factor of Second Region]

On the surface of the electrophotographic member, the average area ratio (coverage factor) of the part covered with the second region is preferably 20% or more and 80% or less and more preferably 30% or more and 70% or less. When the average area ratio is in the above range, swelling of the bottom portion is further suppressed and the convex portion in the first region is in a state of being more collapsed on the second region when the convex portion in the first region is going to be collapsed at the contact portion with another member. As a result, it is possible to generate greater and more complicated deformation as the deformation in a minute region on the surface of the electrophotographic member and contamination due to the toner component is suppressed and high durability without deterioration in performance can be maintained in the durable use as well.

The coverage factor of the second region can be measured as follows. First, the surface of the electrophotographic member is photographed at a magnification of 200-fold by using a video microscope (trade name: DIGITAL MICROSCOPE VHX-500, manufactured by KEYENCE CORPORATION). Next, the coverage factor S of the second region can be determined by processing the image data photographed by the video microscope using commercially available binarization processing software.

Specifically, the coverage factor can be determined by using an automatic image processing analysis apparatus (trade name: LUZEX_AP, manufactured by Nireco Corporation) according to the following procedure. First, the image file obtained by the video microscope is loaded into the image processing software of LUZEX_AP. Before image processing, "Area" is selected with the measurement parameter, and "Margin processing is cut to measure only inside" is set, "Left end" is set to 10, "Right end" is set to 10, "Horizontal" is set to 1260, and "Vertical" is set to 1004 in "Measurement region setting". Thereafter, the boundary between the first region and the second region is traced with a free line by the handwriting correction of the binary image processing, and the region (second region) surrounded by tracing is painted with "FILL HOLES" of "logical filter". Thereafter, the value of the area ratio S' is read by "measurement". The above measurement is performed at arbitrary 20 places of the electrophotographic member, and the arithmetic mean value of the area ratios S' thus obtained is taken as the coverage factor S.

[Electrophotographic Process Cartridge and Electrophotographic Image Forming Apparatus]

An electrophotographic image forming apparatus according to an aspect of the present disclosure includes an image carrier for carrying an electrostatic latent image; a charging apparatus for primarily charging the image carrier, and an exposure apparatus for forming an electrostatic latent image on the image carrier primarily charged. The electrophotographic image forming apparatus further includes a developing apparatus for developing the electrostatic latent image with a toner to form a toner image and a transfer apparatus for transferring the toner image onto a transfer material. Moreover, the developing apparatus includes the electrophotographic member described above, for example, as a developing roller.

Figure 4:
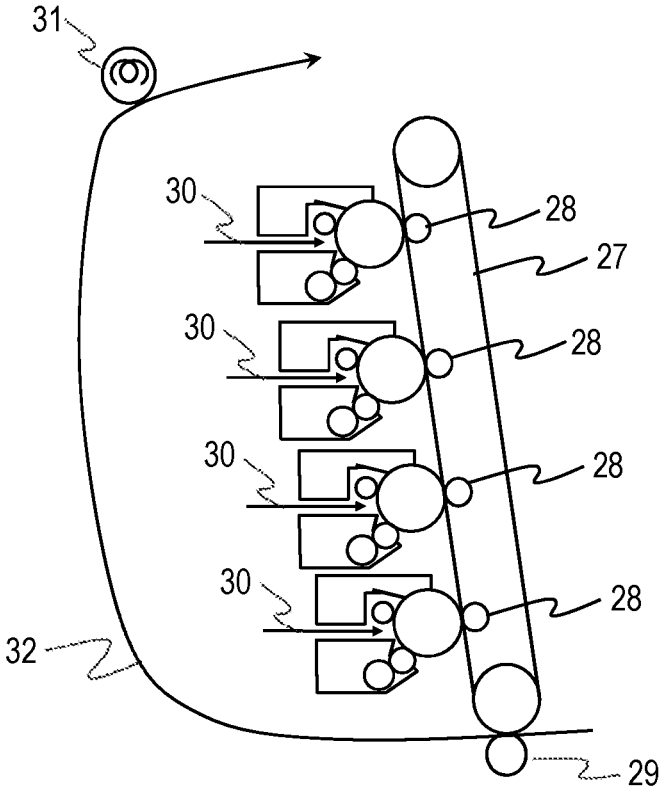
FIG. 4 is a configuration view of an electrophotographic image forming apparatus according to an aspect of the present disclosure.
Figure 5:
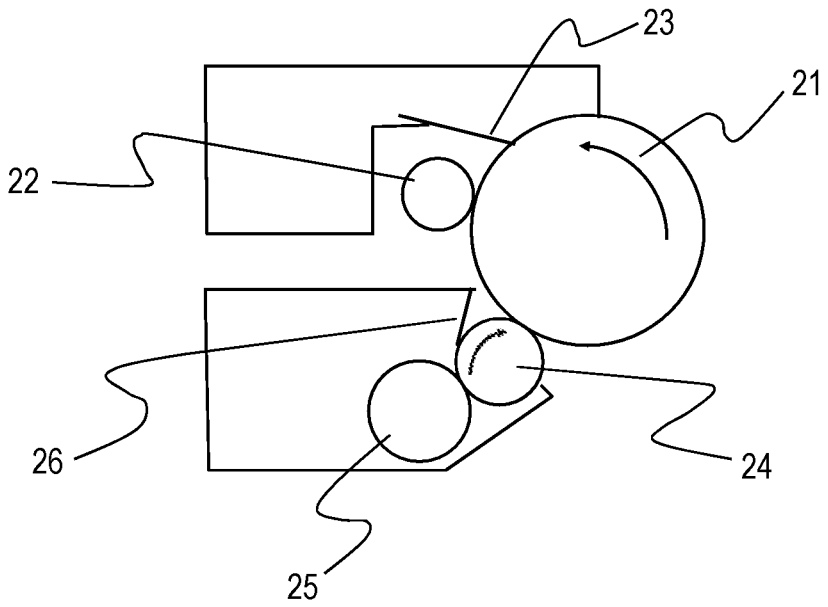
FIG. 5 is a schematic configuration view of an electrophotographic process cartridge according to an aspect of the present disclosure.

The outline of an example of the electrophotographic image forming apparatus according to an aspect of the present disclosure is illustrated in FIG. 4. In addition, the outline of a process cartridge mounted on the electrophotographic image forming apparatus of FIG. 4 is illustrated in FIG. 5. This process cartridge is equipped with a charging apparatus equipped with an image carrier 21 such as a photosensitive drum and a charging member 22, a developing apparatus equipped with a developing member 24, and a cleaning apparatus equipped with a cleaning member 23. Moreover, the process cartridge is configured to be detachably attachable to the main body of the electrophotographic image forming apparatus of FIG. 4.

The image carrier 21 is uniformly charged (primarily charged) by the charging member 22 connected to a bias power supply (not illustrated). The charging potential of the image carrier at this time is, for example, −800 V or more and −400 V or less. Next, the image carrier is irradiated with exposure light 30 for writing an electrostatic latent image by using an exposure apparatus (not illustrated) and an electrostatic latent image is thus formed on the surface thereof. As the exposure light, either LED light or laser light can be used. The surface potential of the image carrier at the part exposed is, for example, −200 V or more and −100 V or less.

Next, the toner negatively charged by the developing member 24 is applied (developed) to the electrostatic latent image, a toner image is formed on the image carrier, and the electrostatic latent image is converted into a visible image. At this time, a voltage of, for example, −500 V or more and −300 V or less is applied to the developing member by the bias power supply (not illustrated). Incidentally, the developing member is in contact with the image carrier with a nip width of, for example, 0.5 mm or more and 3 mm or less. In this process cartridge, a toner feed roller 25 is brought into contact with the developing member in a rotatable state on the upstream side of the rotation of the developing member with respect to the contact portion between the developing blade, which is a toner regulating member 26, and the developing member 24.

The toner image developed on the image carrier is primarily transferred onto an intermediate transfer belt 27. A primary transfer member 28 is in contact with the back surface of the intermediate transfer belt, and the negative toner image is primarily transferred from the image carrier onto the intermediate transfer belt by applying a voltage of, for example, +100 V or more and +1500 V or less to the primary transfer member. The primary transfer member may have a roller shape or a blade shape.

In a case in which the electrophotographic image forming apparatus is a full-color image forming apparatus, typically, the respective steps of charging, exposure, development, and primary transfer described above are performed for the respective colors of yellow, cyan, magenta, and black. For this reason, four process cartridges of which each is equipped with the toner of each color are mounted on the electrophotographic image forming apparatus illustrated in FIG. 4 in a state of being detachably attachable to the main body of the electrophotographic image forming apparatus. Moreover, the respective steps of charging, exposure, development, and primary transfer described above are sequentially performed with a predetermined time difference, and a state in which toner images of four colors for expressing a full color image are superimposed on one another is created on the intermediate transfer belt.

The toner image on the intermediate transfer belt 27 is conveyed to a position facing a secondary transfer member 29 as the intermediate transfer belt rotates. Recording paper is being conveyed along a conveying route 32 of the recording paper at a predetermined timing between the intermediate transfer belt and the secondary transfer member, and the toner image on the intermediate transfer belt is transferred onto the recording paper by applying a secondary transfer bias to the secondary transfer member. At this time, the bias voltage applied to the secondary transfer member is, for example, +1000 V or more and +4000 V or less. The recording paper, on which the toner image has been transferred by the secondary transfer member, is conveyed to a fixing apparatus 31, the toner image on the recording paper is melted and fixed on the recording paper, and then the recording paper is ejected outside the electrophotographic image forming apparatus, whereby the printing operation is completed.

According to an aspect of the present disclosure, it is possible to obtain an electrophotographic member which can suppress adhesion of the toner component to the surface even in the case of printing a large number of sheets. In addition, according to another aspect of the present disclosure, it is possible to obtain an electrophotographic process cartridge which contributes to the stable formation of a high-quality electrophotographic image. According to still another aspect of the present disclosure, it is possible to obtain an electrophotographic image forming apparatus which can stably form a high-quality electrophotographic image.

EXAMPLES

Hereinafter, the present disclosure will be described in more detail with reference to specific Examples, but the present disclosure is not limited thereto. Incidentally, a case in which the elastic layer has a laminated structure of two layers is described in Examples, but the present disclosure is not limited thereto.

Example 1

1. Fabrication of Mandrel

A SUS 304 core grid having an outer diameter of 6 mm and a length of 279 mm was coated with a primer (trade name: DY 35-051, manufactured by Dow Corning Toray Co., Ltd.), and heated at a temperature of 150° C. for 20 minutes, thereby obtaining a mandrel as a support 2. Formation of Second Elastic Layer (Lower Layer)

The mandrel was placed in a cylindrical mold having an inner diameter of 12.0 mm so as to be concentric with the cylinder of the mold. As the material of the second elastic layer, an addition type silicone rubber composition in which the materials presented in the following Table 1 were mixed by using a mixer (product name: Trimix TX-15, manufactured by INOUE MFG., INC.) was injected into the mold heated to a temperature of 115° C. After injection of the materials, the composition was hot molded at a temperature of 120° C. for 10 minutes and the molded body was cooled to room temperature and then released from the mold, thereby obtaining a roller having an elastic layer (lower layer) having a thickness of 2.95 mm formed on the outer periphery of the mandrel.

TABLE 1

Materials for Second Elastic Layer (Lower Layer) Formation

| Materials | Parts by mass |
|---|---|
| Liquid dimethylpolysiloxane having two or more silicon atom-bonded alkenyl groups in one molecule (Trade name: SF3000E, viscosity: 10000 cP, vinyl group equivalent: 0.05 mmol/g, manufactured by KCC Corporation) | 100 |

TABLE 1-continued

Materials for Second Elastic Layer (Lower Layer) Formation

| Materials | Parts by mass |
|---|---|
| Platinum-based catalyst (Trade name: SIP6832.2, manufactured by GELEST, INC.) | 0.048 |
| Dimethylpolysiloxane having two or more silicon atom-bonded hydrogen atoms in one molecule (Trade name: SP6000P, Si—H group equivalent: 15.5 mmol/g, manufactured by KCC Corporation) | 0.5 |
| Carbon black (Trade name: TOKABLACK #7360 SB, manufactured by TOKAI CARBON CO., LTD.) | 6 |

*The numerical values presented in the column of "parts by mass" in the table are the mass of solids in the respective materials.

3. Synthesis of Isocyanate Group-Terminated Prepolymer A

In a nitrogen atmosphere, 150.0 parts by mass of a polyester-based polyol (trade name: P1010 manufactured by Kuraray Co., Ltd.) was gradually added dropwise to 38.4 parts by mass of polymeric MDI (trade name: Millionate MT manufactured by Tosoh Corporation) in a reaction vessel. During the dropwise addition, the temperature in the reaction vessel was kept at 65° C. After completion of the dropwise addition, the reaction was conducted at a temperature of 65° C. for 2 hours. The reaction mixture thus obtained was cooled to room temperature, thereby obtaining 110 parts by mass of an isocyanate group-terminated prepolymer a having an isocyanate group content of 4.7% by mass.

4. Formation of Elastic Layer (Upper Layer) as Surface Layer

The materials presented in the column of component (1) in Table 2 below were stirred and mixed. Thereafter, the mixture thus obtained was added to, mixed with, and then uniformly dispersed in methyl ethyl ketone by using a sand mill so as to have a solid concentration of 30% by mass. The material presented in the column of component (2) in Table 2 was added to a solution prepared by adding methyl ethyl ketone to this mixed solution to adjust the solid concentration to 25% by mass and stirred and dispersed in the solution by using a ball mill, thereby obtaining a coating material for elastic layer (upper layer). Incidentally, the mass presented in Table 2 is the mass of solids in each material. In other words, each material was weighed and used so that the mass excluding the solvent contained in each material was the mass in Table 2.

The roller was coated with the coating material by being dipped in the coating material by an overflow type circulation coating machine so as to have a wet film thickness of 15 μm. Thereafter, the coating film was dried and cured by heating the roller coated at a temperature of 130° C. for 90 minutes to form an elastic layer as a surface layer on the second elastic layer, whereby an elastic layer roller was obtained.

TABLE 2

Materials for Formation of Elastic Layer as Surface Layer

| | | Materials | Parts by mass |
|---|---|---|---|
| Component (1) | Resin | Polyester-based polyol (Trade name: P1012, manufactured by Kuraray Co., Ltd.) | 50 |
| | | Isocyanate group-terminated prepolymer a | 50 |
| | Electroconductive substance | Lithium bis(trifluoromethanesulfonyl)imide (Manufactured by Kishida Chemical Co., Ltd.) | 2 |

TABLE 2-continued

| Materials for Formation of Elastic Layer as Surface Layer | | | |
|---|---|---|---|
| | | Materials | Parts by mass |
| Component (2) | Others | Crosslinked urethane beads (Trade name: Art-pearl C400, volume average particle diameter: 15 μm, manufactured by Negami Chemical Industrial Co., Ltd.) | 15 |

*"Parts by mass" in the table indicates the mass of solids in each material.

5. Formation of Filled Portion

The materials presented in the column of component (1) in Table 3 below were stirred and mixed. Thereafter, the mixture thus obtained was dissolved in and mixed with methyl ethyl ketone so as to have a solid concentration of 5% by mass, thereby obtaining a coating material for filled portion formation.

TABLE 3

| Materials for Filled Portion Formation | | | |
|---|---|---|---|
| | | Materials | Parts by mass |
| Component (1) | Resin | Acrylic polyol (Trade name: PX41-11; manufactured by Asia Industry Co., Ltd.) | 50 |
| | | Hexamethylene diisocyanate (Trade name: Duranate SBB-70P; manufactured by Asahi Kasei Corporation) | 50 |

*The values in the column of "parts by mass" in the table indicate the mass (parts by mass) of solids in each material.

The elastic layer roller was coated with the coating material for filled portion formation by being dipped in the coating material for 1 minute by an overflow type circulation coating machine so that the average value L2 of the heights of the filled portions was the value presented in Table 6 (3 μm in the present Example). Thereafter, the coating film was dried and cured by heating the elastic layer roller coated at a temperature of 140° C. for 80 minutes, thereby obtaining an electrophotographic roller having a filled portion composed of an acrylic urethane resin.

The measurement results on the coverage factor of the second region of the electrophotographic member, the average value L1 of the heights of the convex portions in the first region, the average value L2 of the heights of the filled portions, the Martens hardness H1 measured at the surface of the first region, and the Martens hardness H2 measured at the surface of the second region are presented in Table 6. In addition, the materials for filled portion formation, the coverage factor of the second region, the L2/L1 ratio, and the hardness difference (H2−H1) are presented in Table 7.

Incidentally, the values of H1 and H2 presented here are actually the values of H1max and H2min in the case of being respectively measured at 20 places as described above, and the hardness difference is also the value of (H2min−H1max).

[Evaluation 1: Evaluation on Fogging Occurrence Status in Electrophotographic Image]

The electrophotographic member was mounted on a process cartridge for black for a color laser printer (trade name: CP3520, manufactured by HP Development Company. L.P.) as a developing roller. The toner was once withdrawn from the inside of the process cartridge and refilled by adjusting the filling amount to 100 g. The process cartridge was mounted on the color laser printer and left to stand for 24 hours in an environment at a temperature of 30° C. and a humidity of 80%. Incidentally, the humidity is expressed in terms of relative humidity in the present specification.

Next, an image having a coverage rate of 0.2% was printed by 20000 sheets in the same environment, and then the process cartridge was taken out and the toner remaining in the process cartridge was withdrawn. The process cartridge was filled again with 100 g of toner withdrawn from a new cartridge and left to stand for 24 hours in an environment at a temperature of 30° C. and a humidity of 80%, and then an image having a coverage rate of 0.2% was printed by 20000 sheets in the same manner.

Thereafter, a solid white image was printed using paper of which the whiteness had been measured in advance by using a whiteness meter (trade name: TC-6DS/A whiteness meter, manufactured by Tokyo Denshoku CO., LTD.). Thereafter, the whiteness of the paper was measured by using the whiteness meter in the same manner and the difference in whiteness before and after paper feeding was determined as fogging and evaluated based on the following criteria. The values of fogging and the evaluated ranks are presented in Table 7.

Rank A: less than 1%
Rank B: 1% or more and less than 2.5%
Rank C: 2.5% or more and less than 5%
Rank D: 5% or more and less than 10%
Rank E: 10% or more.

[Evaluation 2: Evaluation on Peeling Off of Second Region (1)]

The electrophotographic member, of which the coverage factor S had been determined in advance, was mounted on a process cartridge for black for a color laser printer (trade name: CP3520, manufactured by HP Development Company. L.P.) as a developing roller. The toner was once withdrawn from the inside of the process cartridge and refilled by adjusting the filling amount to 100 g. The process cartridge was mounted on the color laser printer and left to stand for 24 hours in an environment at a temperature of 30° C. and a humidity of 80%.

Next, an image having a coverage rate of 0.2% was printed by 20000 sheets in the same environment, then the process cartridge was taken out, and the toner remaining in the process cartridge was withdrawn. The process cartridge was filled again with 100 g of toner withdrawn from a new cartridge and left to stand for 24 hours in an environment at a temperature of 30° C. and a humidity of 80%, and then an image having a coverage rate of 0.2% was printed by 20000 sheets in the same manner.

Next, the electrophotographic member was taken out, the area ratio S' at arbitrary 20 places was measured, and the coverage factor S was determined. Next, the peeling rate of the second region domain was determined by the following Calculation Formula (2) and evaluated as follows. The results are presented in Table 7.

Peeling rate (%)=(initial $S-S$ after paper feeding)/initial $S\times100$ Calculation Formula (2)

Evaluation on Peeling Rate of Second Region Domain

Rank A: less than 3%

Rank B: 3% or more and less than 5%

Rank C: 5% or more

[Evaluation 3: Evaluation on Peeling Off of Second Region (2)]

Craft paper-backed tape was cut into a size of 400 mm×400 mm and fixed the adhesive side up by sticking the periphery portion thereof on the desk with tape. The electrophotographic member, of which the coverage factor S had been determined in advance, was pressed on the craft paper-backed tape at a load of 500 g (4.9 N), and the electrophotographic member under the load was reciprocated back and forth by 150 mm each while being rotated by taking the mandrel as the central axis. This was repeatedly performed ten times, the area ratio S' at arbitrary 20 places was measured, and the coverage factor S was determined. Next, the peeling rate of the second region domain was determined by the following Calculation Formula (3) and evaluated as follows. The results are presented in Table 7.

Peeling rate (%)=(initial $S-S$ after paper feeding)/initial $S\times100$ Calculation Formula (3)

Evaluation on Peeling Rate of Second Region Domain

Rank A: less than 5%

Rank B: 5% or more and less than 10%

Rank C: 10% or more

Example 2

An electrophotographic member was prepared and evaluated in the same manner as in Example 1 except that an acrylic polyol (trade name: PLACCEL DC2016, manufactured by DAICEL CORPORATION) was used instead of "PX41-11" when forming the second region.

Example 3

An electrophotographic member was prepared and evaluated in the same manner as in Example 1 except that a polyester-based polyol (trade name: P3010, manufactured by Kuraray Co., Ltd.) was used instead of polyester-based polyol P1012 (trade name, manufactured by Kuraray Co., Ltd.) when preparing the upper elastic layer.

Example 4

A copolymer of styrene, methyl methacrylate, and n-butyl methacrylate (trade name: Hitaroid HA-1470, manufactured by Hitachi Chemical Co., Ltd.) was used instead of "PX41-11" and "SBB-70P" used in Example 1 when forming the second region. This copolymer was dissolved in and mixed with methyl ethyl ketone so as to have a solid concentration of 5% by mass, thereby obtaining a coating material for second region.

An electrophotographic member was prepared and evaluated in the same manner as in Example 1 except that this coating material was used as a coating material for second region and the heating temperature after the elastic layer roller was coated with the coating material for second region was changed from 140° C. to 90° C.

Example 5

When forming the second region, "PX41-11" was changed to a fluorine-based polyol (trade name: F-clear KD270, manufactured by Kanto Denka Kogyo Co., Ltd.) and an isocyanate (trade name: B1370, manufactured by Daicel-Degussa Ltd.) was used instead of SBB-70P. An electrophotographic member was prepared and evaluated in the same manner as in Example 1 except this.

Example 6

When forming the second region, a mixture of a UV curable resin (trade name: 7300K, manufactured by TOAGOSEI CO., LTD.) and an initiator (trade name: IRGACURE 184, manufactured by TOYOTSU CHEMICALPLAS CORPORATION) was used instead of "PX41-11" and "SBB-70P" as a coating material for second region. In addition, the heating temperature after the elastic layer roller was coated with the coating material for second region was changed from 140° C. to 90° C. Furthermore, the coating film was irradiated with ultraviolet light by using a high-pressure mercury lamp (trade name: Handy type UV curing apparatus, manufactured by Mario network) so that the cumulative light quantity was 2000 mJ/cm$^2$ in order to cure the coating film of the coating material for second region. An electrophotographic member was prepared and evaluated in the same manner as in Example 1 except this.

Example 7

An electrophotographic member was prepared and evaluated in the same manner as in Example 6 except that the elastic layer roller was changed to the elastic layer roller 3 prepared in Example 3.

Examples 8 to 13

Electrophotographic members were prepared and evaluated in the same manner as in Example 4 except that "Hitaroid HA-1470" was dissolved in methyl ethyl ketone so that the solid concentration was the concentration presented in Table 4 when forming the second region.

TABLE 4

| Example | Solid concentration (% by mass) |
|---|---|
| 8 | 1.7 |
| 9 | 2.0 |
| 10 | 3.0 |
| 11 | 7.0 |
| 12 | 8.0 |
| 13 | 8.3 |

Example 14

"Hitaroid HA-1470" was dissolved in methyl ethyl ketone so as to have a solid concentration of 1% by mass when forming the second region. The peripheral surface of the elastic roller was coated with liquid thus obtained by using a jet dispenser apparatus (trade name: NANO MASTER SMP-3, manufactured by MUSASHI ENGINEERING, INC.) so that the average height L2 of the filled portion was the height (1 μm in the present Example) presented in Table 6. An electrophotographic member was prepared and evaluated in the same manner as in Example 4 except this.

Examples 15 to 19

Electrophotographic members were prepared and evaluated in the same manner as in Example 14 except that "Hitaroid HA-1470" was dissolved in methyl ethyl ketone so that the solid concentration was the concentration presented in Table 5 when forming the second region.

TABLE 5

| Example | Solid concentration (% by mass) |
|---|---|
| 15 | 3.0 |
| 16 | 7.0 |
| 17 | 8.0 |
| 18 | 9.0 |
| 19 | 10.0 |

Comparative Example 1

An electrophotographic member was prepared and evaluated in the same manner as in Example 1 except that the domain of the second region (filled portion) was not provided.

Comparative Example 2

An electrophotographic member was prepared and evaluated in the same manner as in Example 1 except that "PX41-11" was changed to a polyester-based polyol (trade name: P3010, manufactured by Kuraray Co., Ltd.) and SBB-70P was changed to an isocyanate group-terminated prepolymer a when forming the second region.

Comparative Example 3

An electrophotographic member was prepared and evaluated in the same manner as in Example 14 except that "Hitaroid HA-1470" was dissolved in methyl ethyl ketone so as to have a solid concentration of 13% by mass when forming the second region.

TABLE 6

| | Domain coverage factor (%) | Average height L1 of convex portion (μm) | Average height L2 of filled portion (μm) | Hardness H1 of first region ($N/mm^2$) | Hardness H2 of second region ($N/mm^2$) |
|---|---|---|---|---|---|
| Example 1 | 49 | 12 | 3 | 1.5 | 1.6 |
| Example 2 | 48 | 12 | 3 | 1.5 | 2.0 |
| Example 3 | 51 | 11 | 3 | 0.6 | 1.6 |
| Example 4 | 49 | 12 | 3 | 1.4 | 10.7 |
| Example 5 | 50 | 11 | 5 | 1.5 | 14.3 |
| Example 6 | 47 | 12 | 4 | 1.4 | 31.4 |
| Example 7 | 51 | 12 | 4 | 0.5 | 35.5 |
| Example 8 | 17 | 13 | 4 | 1.4 | 10.6 |
| Example 9 | 20 | 12 | 4 | 1.5 | 10.7 |
| Example 10 | 30 | 12 | 4 | 1.5 | 10.6 |
| Example 11 | 70 | 12 | 4 | 1.5 | 10.8 |
| Example 12 | 80 | 11 | 5 | 1.5 | 10.7 |
| Example 13 | 88 | 12 | 5 | 1.6 | 10.9 |
| Example 14 | 48 | 13 | 1 | 1.5 | 10.4 |
| Example 15 | 49 | 12 | 2 | 1.6 | 10.5 |
| Example 16 | 50 | 13 | 6 | 1.6 | 10.8 |
| Example 17 | 49 | 12 | 8 | 1.5 | 10.8 |
| Example 18 | 49 | 11 | 9 | 1.5 | 11.0 |
| Example 19 | 51 | 12 | 11 | 1.5 | 11.2 |
| Comparative Example 1 | 0 | 12 | — | 1.5 | — |
| Comparative Example 2 | 48 | 13 | 4 | 1.5 | 0.6 |
| Comparative Example 3 | 50 | 11 | 12 | 1.4 | 11.4 |

TABLE 7

| | | Domain material | Hardness difference H2 − H1 | Coverage factor of second region (%) | L2/L1 | Evaluation 1 Whiteness difference (%) | Evaluation 1 Evaluated rank | Evaluation 2 Peeling rate (%) | Evaluation 2 Evaluated rank | Evaluation 3 Peeling rate (%) | Evaluation 3 Evaluated rank |
|---|---|---|---|---|---|---|---|---|---|---|---|
| Example | 1 | Acrylic urethane | 0.1 | 49 | 0.3 | 3.3 | C | 2.1 | A | 2.5 | A |
| | 2 | Acrylic urethane | 0.5 | 48 | 0.3 | 1.3 | B | 1.7 | A | 1.2 | A |
| | 3 | Acrylic urethane | 1.0 | 51 | 0.3 | 0.9 | A | 1.9 | A | 2.0 | A |
| | 4 | Styrene | 9.3 | 49 | 0.3 | 0.7 | A | 2.2 | A | 2.3 | A |
| | 5 | Fluorourethane | 12.8 | 50 | 0.5 | 0.6 | A | 2.5 | A | 3.5 | A |

TABLE 7-continued

| | | Domain material | Hardness difference H2 − H1 | Coverage factor of second region (%) | L2/L1 | Evaluation 1 Whiteness difference (%) | Evaluation 1 Evaluated rank | Evaluation 2 Peeling rate (%) | Evaluation 2 Evaluated rank | Evaluation 3 Peeling rate (%) | Evaluation 3 Evaluated rank |
|---|---|---|---|---|---|---|---|---|---|---|---|
| | 6 | Acryl | 30.0 | 47 | 0.3 | 0.7 | A | 2.8 | A | 4.4 | A |
| | 7 | Acryl | 35.0 | 51 | 0.3 | 1.0 | B | 4.1 | B | 7.4 | B |
| | 8 | Styrene | 9.2 | 17 | 0.3 | 2.8 | C | 2.0 | A | 2.5 | A |
| | 9 | Styrene | 9.2 | 20 | 0.3 | 2.4 | B | 2.4 | A | 3.3 | A |
| | 10 | Styrene | 9.1 | 30 | 0.3 | 0.8 | A | 2.3 | A | 2.7 | A |
| | 11 | Styrene | 9.3 | 70 | 0.3 | 0.8 | A | 2.2 | A | 2.5 | A |
| | 12 | Styrene | 9.2 | 80 | 0.5 | 1.6 | B | 2.1 | A | 2.6 | A |
| | 13 | Styrene | 9.3 | 88 | 0.4 | 2.7 | C | 2.3 | A | 3.1 | A |
| | 14 | Styrene | 8.9 | 48 | 0.1 | 2.6 | C | 1.9 | A | 2.2 | A |
| | 15 | Styrene | 8.9 | 49 | 0.2 | 2.2 | B | 2.3 | A | 3.2 | A |
| | 16 | Styrene | 9.2 | 50 | 0.5 | 0.5 | A | 2.2 | A | 2.6 | A |
| | 17 | Styrene | 9.3 | 49 | 0.7 | 0.9 | A | 2.7 | A | 3.8 | A |
| | 18 | Styrene | 9.5 | 49 | 0.8 | 2.3 | B | 3.5 | B | 6.5 | B |
| | 19 | Styrene | 9.7 | 51 | 0.9 | 2.7 | C | 4.8 | B | 8.9 | B |
| Comparative Example | 1 | — | — | 0 | — | 11.6 | E | — | — | — | — |
| | 2 | Ester urethane | −0.9 | 48 | 0.3 | 7.6 | D | 2.6 | A | 3.7 | A |
| | 3 | Styrene | 10.0 | 50 | 1.1 | 10.5 | E | 8.9 | C | 19.5 | C |

In Examples 1 to 19, it was confirmed that there were first and second regions in each cross section (cross section in the elastic layer thickness direction along the longitudinal direction of the roller-shaped electrophotographic member) for measuring L1' and L2' when these were measured. At the same time, it was also confirmed that the second region was formed between the convex portions to a height lower than the heights of these convex portions in each cross section.

In Examples 1 to 19, the fogging was minor and the amount of the second region peeled off was also small.

In Examples 1 to 7, the Martens hardness difference (H2−H1) is greatly changed. In Examples 2 to 7, the evaluation results on fogging were more favorable as compared with that in Example 1 as the Martens hardness difference (H2−H1) was 0.5 $N/mm^2$ or more and 35.0 $N/mm^2$ or less.

In Examples 4 and 8 to 13, only the solid concentration in the coating material for second region is changed. In Examples 4 and 9 to 12, the evaluation results on fogging were more favorable as compared with those in Examples 8 and 13 as the coverage factor of the second region was 20% or more and 80% or less.

In Example 4 and Examples 14 to 19, the coating method of the coating material for second region and the solid concentration in the coating material for second region are different from one another. In Examples 14 to 19, only the solid concentration in the coating material for second region is changed. In Examples 4 and 15 to 18, the evaluation results on fogging or peeling off of the second region domain were more favorable as compared with those in Examples 14 and 19 as the height ratio L2/L1 was 0.2 or more and 0.8 or less.

On the other hand, in Comparative Example 1, the second region (filled portion) was not provided. Hence, the toner component adhered to the electrophotographic member (charging roller), the charging imparting property deteriorated, and fogging was severer. In Comparative Example 2 as well, the toner component adhered to the electrophotographic member, the charging imparting property deteriorated, and fogging was severer since the relationship between hardnesses was H1≤H2. In Comparative Example 3, the height of the filled portion was higher than the height of the convex portion in the first region and a part of the second region (filled portion) dropped out by the frequency of rubbing with another member. In addition, great and non-uniform deformation of the convex portion in the first region did not occur since the second region having a high hardness came into strong contact with another member and the first region having a low hardness did not come into strong contact with another member. Consequently, the layer contaminated by the toner component on the surface of the electrophotographic member was hardly cracked or peeled off and thus the charging imparting property deteriorated and fogging was severer.

It has been confirmed that there is a correlation between the pilot experiment and the evaluation by the roller alone in the peeling off of the second region domain.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-136341, filed Jul. 12, 2017, which is hereby incorporated by reference herein in its entirety.

What is claimed is:

1. An electrophotographic member comprising an electroconductive support and an elastic layer on the support, wherein the electrophotographic member has convex portions composed of the elastic layer on a surface of the electrophotographic member, the electrophotographic member has a filled portion containing a resin at a valley portion between the convex portions, the filled portion has a height lower than heights of the convex portions, the surface of the electrophotographic member includes a first region which is a surface of the elastic layer uncovered with the filled portion and a second region which is a surface of the filled portion, and wherein when a Martens hardness measured at a surface of the first region is defined as H1, and a Martens hardness measured at a surface of the second region is defined as H2, H1 and H2 satisfy a following relationship: H2>H1.

2. The electrophotographic member according to claim 1, wherein the electrophotographic member has a roller shape.

3. The electrophotographic member according to claim 1, wherein a difference between H1 and H2 is 0.5 $N/mm^2$ or more and 35.0 $N/mm^2$ or less.

4. The electrophotographic member according to claim 1, wherein a coverage factor of a part covered with the second region on the surface of the electrophotographic member is 20% or more and 80% or less.

5. The electrophotographic member according to claim 1, wherein L2/L1 is 0.2 or more and 0.8 or less where L1 denotes an average value of the heights of the convex portions and L2 denotes an average value of the heights of the filled portions.

6. An electrophotographic process cartridge which is configured to be detachably attachable to a main body of an electrophotographic image forming apparatus and equipped with a developing apparatus including an electrophotographic member, wherein the electrophotographic member includes an electroconductive support and an elastic layer on the support, the electrophotographic member has convex portions composed of the elastic layer on a surface of the electrophotographic member, the electrophotographic member has a filled portion containing a resin at a valley portion between the convex portions, the filled portion has a height lower than heights of the convex portions, the surface of the electrophotographic member includes a first region which is a surface of the elastic layer uncovered with the filled portion and a second region which is a surface of the filled portion, and wherein when a Martens hardness measured at a surface of the first region is defined as H1, and a Martens hardness measured at a surface of the second region is defined as H2, H1 and H2 satisfy a following relationship: H2>H1.

7. The electrophotographic process cartridge according to claim 6, comprising the electrophotographic member as a developing member.

8. The electrophotographic process cartridge according to claim 7, further comprising at least one member selected from the group consisting of a toner feed roller, a toner regulating member, and an electrophotographic photosensitive member, wherein the member is in contact with a surface of the developing member.

9. An electrophotographic image forming apparatus comprising:

an image carrier for carrying an electrostatic latent image;

a charging apparatus for primarily charging the image carrier;

an exposure apparatus for forming an electrostatic latent image on the image carrier primarily charged;

a developing apparatus for developing the electrostatic latent image with a toner to form a toner image; and a transfer apparatus for transferring the toner image onto a transfer material, wherein the developing apparatus includes an electrophotographic member, the electrophotographic member has convex portions composed of an elastic layer on a surface of the electrophotographic member, the electrophotographic member has a filled portion containing a resin at a valley portion between the convex portions, the filled portion has a height lower than heights of the convex portions, the surface of the electrophotographic member includes a first region which is a surface of the elastic layer uncovered with the filled portion and a second region which is a surface of the filled portion, and wherein when a Martens hardness measured at a surface of the first region is defined as H1, and a Martens hardness measured at a surface of the second region is defined as H2, H1 and H2 satisfy a following relationship: H2>H1.

10. The electrophotographic image forming apparatus according to claim 9, further comprising at least one member selected from the group consisting of a toner feed roller, a toner regulating member, and an electrophotographic photosensitive member, wherein the member is in contact with a surface of the developing member.

* * * * *